United States Patent [19]

Lemkin et al.

[11] Patent Number: 4,850,555

[45] Date of Patent: Jul. 25, 1989

[54] STAKE AND COUPLER FOR IRRIGATION DEVICE

[75] Inventors: Jack L. Lemkin, Cincinnati; Carl A. Peterson; Eugene A. Zilber, both of Columbus, all of Ohio

[73] Assignee: The O.M. Scott & Sons Company, Marysville, Ohio

[21] Appl. No.: 563,956

[22] Filed: Dec. 21, 1983

[51] Int. Cl.[4] ..... B05B 15/08

[52] U.S. Cl. ..... 248/87; 248/156; 248/159

[58] Field of Search ..... 248/85, 86, 87, 88, 248/156, 545, 533, 532, 159; 239/276; 403/305, 301, 292; 135/118

[56] References Cited

U.S. PATENT DOCUMENTS

| | | | |
|---|---|---|---|
| 1,672,927 | 6/1928 | Burk | 135/118 X |
| 2,618,902 | 11/1952 | Prescott | 248/87 X |
| 2,679,911 | 6/1954 | Bhend | 403/292 X |
| 3,425,632 | 2/1969 | Stout | 239/276 X |
| 3,473,770 | 10/1969 | Edgerton | 248/87 |
| 3,579,908 | 5/1971 | Morgan | 403/305 X |
| 3,638,863 | 2/1972 | Roberts | 248/87 X |
| 3,788,552 | 1/1974 | Roberts | 239/276 |
| 4,132,489 | 1/1979 | Berg, Jr. et al. | 403/305 |
| 4,256,262 | 3/1981 | Rosenberg et al. | 248/88 X |
| 4,314,771 | 2/1982 | Lambert | 403/305 |
| 4,319,425 | 3/1982 | Shine | 248/88 X |

OTHER PUBLICATIONS

Catalog of Lego M. Lemelshtrich Ltd., Netania, Israel, p. 3 and 3 additional unnumbered pages.

Catalog of RIS Irrigation Systems, 1588 North Marshall Ave., El Cajon, Ca., 2 pages.

Catalog of Dan Sprinklers, Kibbutz Dan, Israel, 4 pages.

*Primary Examiner*—Ramon S. Britts

*Assistant Examiner*—David M. Purol

[57] ABSTRACT

A stake and coupler for holding an irrigation device, such as a sprinkler, for use in a home gardening watering system. The stake is an elongated plastic body having a substantially constant multilobed crosssection. One end of the stake has a projection for mounting an irrigation device, the other end a pointed tip for anchoring the stake in the ground. The coupler is a hollow plastic body, both ends of which contain identical openings and which will receive either end of the stake for joining two stakes together.

5 Claims, 1 Drawing Sheet

STAKE AND COUPLER FOR IRRIGATION DEVICE

This invention relates to a stake for use in holding an irrigation device, to a coupler member for joining together two or more such stakes and to the combination of the stake and coupler.

Home garden or foundation watering systems are becoming increasingly more popular as an economical and convenient means of irrigating garden, ornamental and foundation plants. These systems normally include small sprinklers, drippers or emitters, connecting tubing and connectors adapted to be assembled by the home gardner in accordance with his or her specific garden or landscaping requirements. Such irrigation systems also frequently including a stake or other support means for holding and positioning the small sprinklers at the appropriate elevation and distance from the plants. These stakes have assumed a variety of configurations and designs, all of which have been deficient in one or more respects. Many have a non-constant cross section and accordingly involve poor material use and are difficult to store. Most cannot be conveniently stacked, one upon the other, to provide different sprinkler elevations.

The present invention provides a stake configuration having a substantially constant cross section which permits economical storage. In addition, the stake design provides effective use of material and permits, in combination with a coupling member, convenient stacking of two or more stakes to provide a variety of sprinkler elevations. The design of the coupling member and stake are such that either end of the stake, even though they are of different configuration, may be mounted in either end of the coupling member.

More specifically, the invention is directed to a stake for holding an irrigation device comprising a plastic body elongated along a given axial direction, one axial end thereof having a projection adapted to mount an irrigation device thereon and the opposite axial end having a tip adapted to anchor the stake in the ground. The cross section of the body of the stake in a direction transverse to the axis of elongation has a substantially constant multilobed configuration, the extremities of the lobes forming a plurality of uninterrupted straight edges extending the entire length of the body between the projection and tip at the respective ends thereof, the projection and pointed tip also being adapted to be interchangeably mounted in a coupling member adapted to join together two or more of the stakes in series. The coupling member for holding together two of the stakes comprises a plastic body having a multilobed shaped hollow interior of constant configuration extending along its entire length, said hollow interior forming identical openings at the opposite ends of said coupling, said openings adapted to receive and retain by friction fit the extremities of a stake. The invention also comprises the combination of two or more of the aforesaid stakes and one or more of the coupling members.

The invention will be better understood by reference to the accompanying drawing in which.

Figures 1, 2, 3, 4, 5, 6, 7, 8, 9, 10, 11, 12:
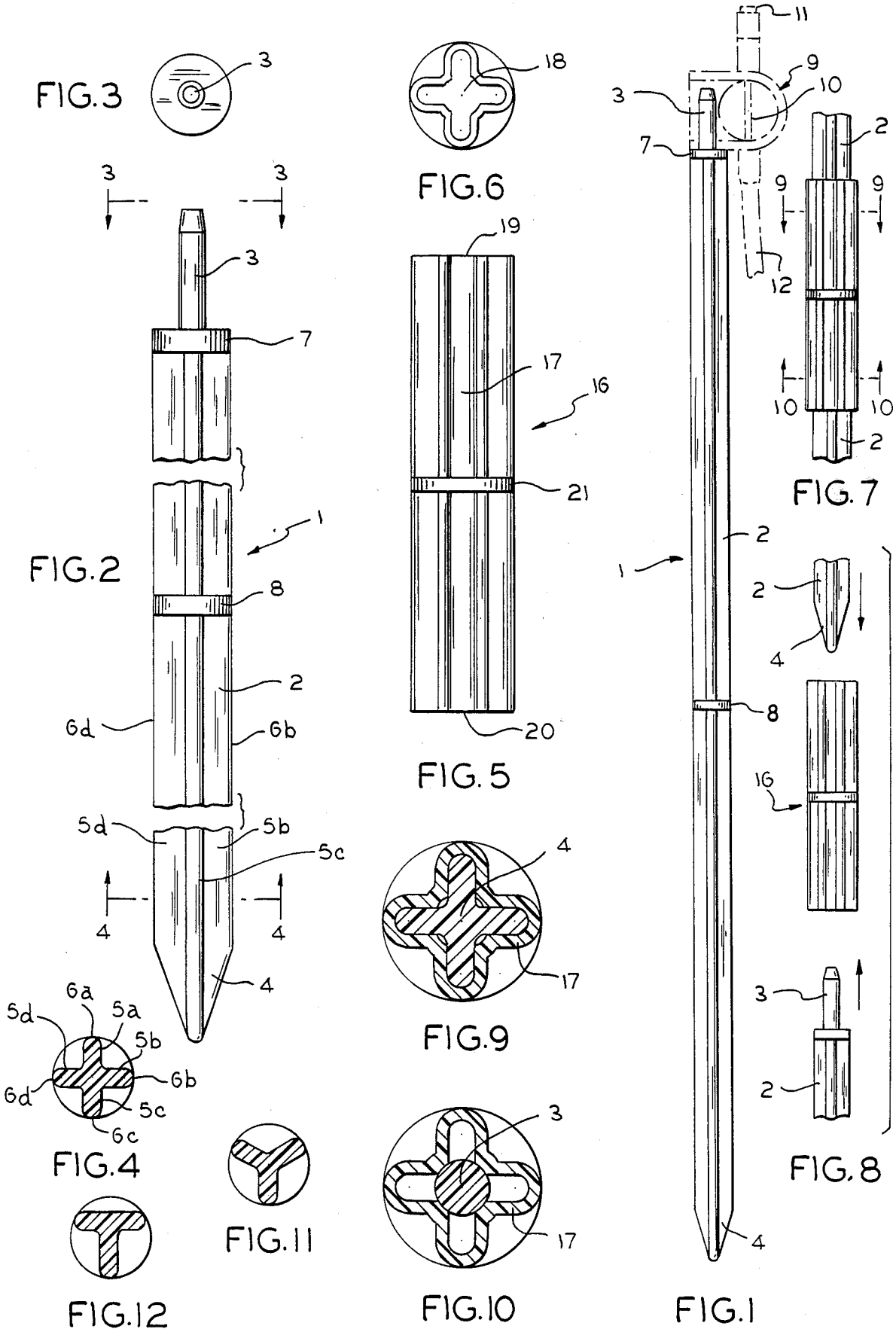
FIG. 1 is an elevational view of a stake, with a sprinkler shown mounted thereon in phantom outline, in accordance with one embodiment of the invention.
FIG. 2 is an enlarged fragmentary view of the stake shown in FIG. 1.
FIG. 3 is a top plan view along the lines 3—3 of FIG. 2.
FIG. 4 is a cross-sectional view along the lines 4—4 of FIG. 2.
FIG. 5 is an enlarged elevational view of a coupler in accordance with one embodiment of the invention.
FIG. 6 is a plan view of the top (or bottom) of the coupler.
FIG. 7 is a fragmentary elevational view of an assembled coupler and two stakes.
FIG. 8 is an exploded view of the coupler and stakes shown in FIG. 7.
FIG. 9 is an enlarged cross-sectional view taken along the lines 9—9 of FIG. 7.
FIG. 10 is an enlarged cross-sectional view taken along the lines 10—10 of FIG. 7.
FIGS. 11 and 12 are cross-sectional views similar to FIG. 4 showing alternate cross-sectional configurations of the stake.

As can be seen from FIG. 1–4, the stake, generally indicated at 1, comprises an elongated plastic body 2 having a projection 3 at one axial end thereof and a pointed tip 4 at the opposite axial end thereof. The body 2 of the stake is X-shaped in cross section in a direction transverse to the axis of elongation as most clearly seen in FIG. 4. The projection 3 is cylindrical or round in cross section whereas the tip 4 is X-shaped in cross section. The legs 5*a*, 5*b*, 5*c* and 5*d* of the X-shaped cross section form straight edges 6*a*, 6*b*, 6*c* and 6*d* respectively extending the entire length of the body between the cylindrical projection and pointed tip at the respective ends of the stake body. Two or more disc-shaped sections 7 and 8 are located at spaced apart portions of the stake; section 7 being at the top of the body portion and section 8 being at an intermediate portion of the body. A sprinkler 9 is shown in FIG. 1 in phantom outline mounted on the stake 1. The sprinkler has a valve 10, a sprinkler head 11 connected through tubing 12 to a suitable water source.

A coupler 16 is shown in FIGS. 5 and 6. The coupler has a plastic body 17 which has an X-shaped hollow interior 18 of constant configuration extending along the entire length of the coupler. The hollow interior forms identical openings 19 and 20 at the opposite ends of the coupling. A disc-shaped section 21 is located on the exterior of the coupler at approximately its midpoint. The pointed tip 4 and the projection 3 on stake 1 are adapted to be mounted in either end of the coupler 16. In FIG. 7 and 8, tip 4 is shown mounted at one end of the coupler and projection 3 mounted in the other end. As shown in FIGS. 9 and 10, the tip 4 and projection 3 are retained in the hollow interior of the coupling by friction fit. The constant wall and unique cross section of the coupling is designed to allow sufficient flexure to accomodate variations in the dimensions of the stake. In this fashion, two stakes may be mounted in a coupling to provide a sprinkler elevation of approximately twice that of a single stake. Similarly, a second coupler can be added to couple a third stake to provide even greater elevation to the sprinkler location.

In place of the X-shaped stake and corresponding X-shaped coupler shown in FIGS. 1–10, the stake and coupler may take other multilobed configurations. FIGS. 11 and 12 shown a Y- and T-shaped stake respectively. The coupler would of course have a corresponding multilobed cross-sectional configuration.

The design of the stake and the coupler are such that either end of the coupler may be used for receiving either end of the stake and vice versa. Thus, fewer components are necessary to assemble the irrigation system and greater forgiveness is permitted in setting up the system. The X, Y or T cross-sectional shape of the stake contributes strength while the disc-shaped sections on the stake and coupler contribute rigidity to these plastic components and are also of assistance in gripping the components for separation of the stake and coupler. As previously indicated, the coupler and stake configuration are such that a firm but resilient gripping action is provided. The stake and coupler are conveniently made of a resilient plastic material such a polyethylene or butadiene-styrene.

We claim:

1. In combination, two or more identical stakes for holding an irrigation device and a coupling member for joining together said stakes, each stake comprising a plastic body elongated along a given axial direction, one axial end thereof having a projection adapted to mount an irrigation device thereon, the opposite axial end having a tip adapted to anchor said stake in the ground, the cross section of said stake body in a direction transverse to the axis of elongation having a substantially constant multilobed configuration, the extremeties of the legs of the lobes forming a plurality of uninterrupted straight edges extending the entire length of the body between the projection and tip at the respective ends thereof, said projection at said one axial end being round in cross section and said tip at said opposite axial end being multilobed in cross section, said stake having at least two disc-shaped sections located at spaced apart portions of the stake, said projection and pointed tip also being adapted to be interchangeably mounted in said coupling member adapted to join together two or more of said stakes in series, said coupling member having identical openings at the opposite ends thereof, the projecting end of one of said stakes being mounted and retained by friction fit in one end of the coupling member, the tip end of the other stake being mounted and retained by friction fit in the other end thereof.

2. The coupling member of claim 1, said coupling member comprising a plastic body having a multilobed shaped hollow interior of constant configuration extending along its entire length, said hollow interior forming identical openings at the opposite ends of said coupling, said openings adapted to interchangeably receive and retain by friction fit the extremeties of a stake having as one extremity a projection being round in cross section and the opposite extremity being multilobed in cross section.

3. The stakes of claim 1, in which the cross section of the body of each stake in a direction transverse to the axis of elongation is X-shaped.

4. The stakes of claim 1, in which the cross section of the body of each stake in a direction transverse to the axis of elongation is Y-shaped.

5. The stakes of claim 1, in which the cross section of the body of each stake in a direction transverse to the axis of elongation is T-shaped.

* * * * *